United States Patent [19]

Horsewell

[11] 4,380,241

[45] Apr. 19, 1983

[54] SMOKING ARTICLES

[75] Inventor: Henry G. Horsewell, Totton, England

[73] Assignee: British-American Tobacco Company Limited, London, England

[21] Appl. No.: 255,091

[22] Filed: Apr. 17, 1981

[30] Foreign Application Priority Data

May 1, 1980 [GB] United Kingdom ..... 8014455

[51] Int. Cl.[3] ..... A24D 3/04; A24D 3/18

[52] U.S. Cl. ..... 131/336; 131/338; 131/339; 131/340

[58] Field of Search ..... 131/336, 337, 338, 339, 131/340, 344, 345, 198 R, 198 A, 211, 216

[56] References Cited

U.S. PATENT DOCUMENTS

| | | | |
|---|---|---|---|
| 1,718,122 | 6/1929 | De Shon | 131/336 |
| 2,819,720 | 1/1958 | Burbig | 131/336 |
| 3,490,461 | 1/1970 | Osmalov et al. | 131/336 |
| 4,135,523 | 1/1979 | Luke et al. | 131/336 |
| 4,256,122 | 3/1981 | Johnson | 131/336 |

FOREIGN PATENT DOCUMENTS

| | | | |
|---|---|---|---|
| 736743 | 6/1966 | Canada | 131/339 |
| 1365712 | 5/1964 | France | 131/339 |
| 1436636 | 5/1976 | United Kingdom | 131/339 |

*Primary Examiner*—V. Millin

*Attorney, Agent, or Firm*—Kane, Dalsimer, Kane, Sullivan and Kurucz

[57] ABSTRACT

A smoking article comprises a smoking material rod and, to one end thereof, a flow-impedance device comprising a rod-like element of foam or fibrous material which is or has been rendered impervious to the flow of smoke therethrough and one or more open-ended smoke-flow passages extending from one end to the other of the element, the pressure drop of the passage or passages being in the range from 40 to 200 mm, preferably 50 to 100 mm, water gauge and said device being enclosed in a wrapping permitting inward flow of ambient air into the device, which has air-conducting means whereby air flowing inwardly through the wrapping is conducted to the mouth end of the device, the device being effective to remove not more than 25%, preferably 20%, of the total particulate matter of the smoke. The passage or passages may be formed by a bore or bores in the material or by a capillary tube or tubes.

11 Claims, 3 Drawing Figures

SMOKING ARTICLES

Figure 1:
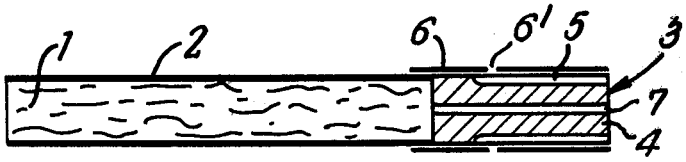

This invention concerns smoking articles, cigarettes for example.

Low-delivery cigarettes, with a delivery of 9 mg total particulate matter (TPM) for example, or even as low as 1 mg or less, are being currently marketed. A low-delivery cigarette may have a draw resistance which to the smoker is unacceptably low. If the draw resistance of a filter of a low delivery filter cigarette is so selected as to increase the draw resistance of the cigarette to an acceptable level, the filtration effect might well be overgreat for the low-delivery tobacco rod and this could result in a characterless cigarette.

It is common, in filter tip cigarettes, to provide for the ingress of air into the filter, whereby a reduction in the smoke delivery can, for example be achieved. To obtain an acceptably high air/smoke ratio, a high pressure drop upstream of the ingress or ventilation zone is then required. If, in order to realise this, use is made of a conventional filter with a high pressure drop, the filtration effect for TPM will be comparatively high, for which reason this expedient is unsuitable in the case of a cigarette with a low-delivery tobacco rod, from which namely the delivery is already low.

It is an object of the present invention to provide means for use in a low-delivery smoking article, particularly a cigarette, which, although providing for a desirable draw-resistance value and making adequate ventilation possible, has a minimal TPM removal effect.

The present invention provides a smoking article comprising a smoking material rod and, to one end thereof, a flow-impedance device comprising a rod-like element of foam or fibrous material which is or has been rendered impervious to the flow of smoke therethrough and one or more open-ended smoke-flow passages extending from one end to the other of the element, the pressure drop of the passage or the total pressure drop of the passages, determined at a flow rate through the device of 17.5 $cm^3$ per second, being in the range from 40 to 200 mm water gauge and said device being enclosed in a wrapping permitting the inward flow of ambient air therethrough into said device, said device having air-conducting means whereby air flowing inwardly through said wrapping may be conducted to and outwardly from the mouth end of said device, and said device being effective to remove not more than 25% of the total particulate matter of the smoke passing through the device when the smoking article is smoked.

The smoke-flow passages may be formed in the said material, for example as bores, but advantageously they are defined by lengths of capillary tubing. If a single passage is used, the internal diameter thereof may be from 0.5–1.5 mm and preferably from 0.8–1.0 mm. If one passage only is used, it need not be disposed within the rod-like element co-axially therewith. It may, for example be disposed near the periphery of the element. The or each passage is conveniently straight, but can have other configuration, spiral for example.

The pressure drop of the passage(s) is preferably in the range of 50–100 mm water gauge at the flow rate of 17.5 $cm^3$ per second.

Advantageously, the flow-impedance device should not exhibit a TPM removal effect in excess of 20% and it may be considerably less.

The length of the device may be within the range of 6–30 mm and suitably within the range of 11–25 mm.

A capillary tube of smoke-impervious plastics material 15 mm long and having an internal diameter of 0.8 mm was found to have a pressure drop, at a flow rate of 17.5 $cm^3$ per second, of 100 mm water gauge and had a TPM removal effect of less than 5%.

The material of the rod-like element of the flow-impedance device may be a plastics material, polypropylene, polyethylene, or cellulose acetate for example, with a closed-cell foam structure, in which case the material is inherently impervious to the flow of smoke. If an open-cell foam material is used, cellulose acetate or a material such as is disclosed in United Kingdom Patent Specification No. 1,271,274 for example, the element may be rendered impervious to the flow of smoke therealong by forming an annular groove therein extending over the cross-section of the element, other than the cross-section occupied by a single axially disposed smoke-flow passage, by a heat-moulding process as disclosed in U.S. Pat. No. 4149546. The surfaces of the annular groove may be glazed as a result of the heat-moulding process, but the imperviousness of the walls of the groove to the flow of smoke may be achieved or enhanced by the deposition in the groove of a sealant material. By "open-cell" material, we mean that a high proportion of the cells intercommunicate, thus providing a material with an inherent smoke perviousness. The heat-moulding process may be similarly used to render smoke-impervious a cross-section of an element formed of fibrous thermoplastic material, cellulose acetate or polypropylene for example. Alternatively, an element of material which is not inherently impervious may be rendered impervious by heat glazing or coating an end surface.

If it is desired that the smoking article should have a plain mouth-end surface, in appearance the same as an orthodox filter-tip cigarette, a plug of filtration material, cellulose acetate for example, may be disposed at the mouth end. However, as above mentioned, significant filtration effects are to be avoided and for this reason the mouth end of the or each smoke-flow passage should not abut such a mouth-end plug. One practical arrangement is to provide an empty recess or cavity between the element and the plug, in which case conveniently the wrapping is air permeable in the zone thereof overlying the cavity or recess.

If the rod-like element is formed of an open-cell or closed-cell foam, the method of manufacture may comprise extrusion of the foam in rod form, the rod being subsequently cut into suitable lengths. If the or each smoke-flow passage is to be defined by the walls of a tube, the foam material may be extruded around the tube or tubes by use of a crosshead die.

If the element is formed of a fibrous material such as a cellulose acetate or polypropylene tow, the material may be fed together with a continuous length or lengths of tubing into a garniture device which serves to bring the material to a rod form. The tubing is suitably of a plastics material, polyethylene or polypropylene for example.

Figure 1A:
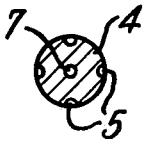
Figure 2:
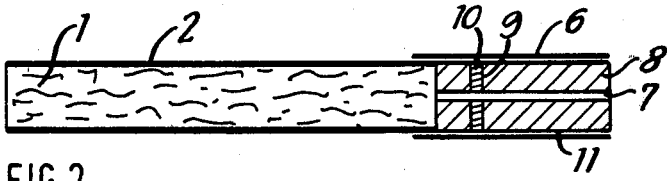
Figure 3:
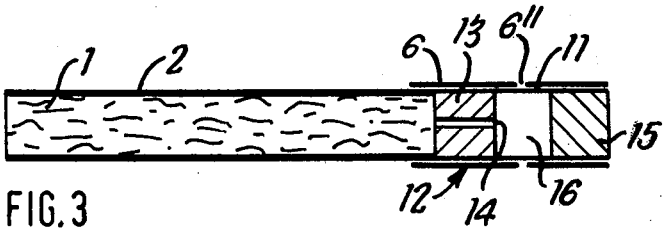

In order that the invention may be clearly understood and readily carried into effect, reference will now be made, by way of example, to the accompanying drawing, in which;

FIG. 1 is a diagrammatic longitudinal section through a cigarette embodying one form of flow-impedance element;

FIG. 1*a* is a transverse cross section through the element shown in FIG. 1;

FIG. 2 is a view similar to FIG. 1, but showing a different form of impedance element, and FIG. 3 is a view similar to FIG. 1 but showing a third form of impedance element.

The cigarette of FIG. 1 comprises a low-delivery rod 1 of tobacco wrapped within cigarette paper 2 and a flow impedance device 3 comprising a rod-like element 4 of closed-cell cellulose acetate attached to the wrapped rod 1 by tipping 6 having a ring of ventilation perforations 6'. Embedded within the foamed cellulose acetate of the element 3 and disposed axially of the element is an open-ended capillary tube 7 of plastics material which extends over the full length of the element 3. Four grooves 5 equi-angularly disposed (see FIG. 1*a*) are formed in the peripheral surface of the element 3. The grooves extend from a location short of the tobacco rod 1 and open at the mouth end of the element 4.

The cigarette shown in FIG. 2 embodies a flow-impedance device similar to that of FIG. 1, but in which the rod-like element 8 is composed of cellulose acetate tow which has been rendered impervious to the flow of tobacco smoke at an annular cross-section of the element by heat-moulding a groove 9 in the element at a location remote from the mouth end thereof and depositing barrier sealant material 10 in the groove 9. In order to provide for ventilation, the plugwrap 11 is porous and the tipping 6 is porous or perforated at least at the downstream side of the groove 9.

In FIG. 3, the ciagarette comprises a flow-impedance device 12 comprising a relatively short rod-like element 13 formed of closed-cell polypropylene and having formed therein an axially extending open-ended bore 14 providing a smoke-flow passage. The device 12 further comprises a short plug 15, with a low pressure drop, spaced from the downstream end of the element 13, thus to provide an intervening empty cavity 16. The plugwrap 11 is porous and the tipping 6 is provided with a ring of perforation holes 6" overlying the cavity 16.

In a variation of the cigarette of FIG. 3 the plug 15 is omitted, thus providing a recessed mouthpiece to the downstream side of the element 13.

To illustrate the manner in which the pressure drop and TPM removal effect vary with the cross section of flow passage of the flow-impedance device in one example, a number of such devices A–F similar to that of FIG. 2 were made with tubes of plastics material of different internal diameters, each device being 20 mm long. The devices were tested to determine the pressure drop, at a flow rate of 17.5 $cm^3$ per second, and the TPM removal effect of each. The following results were recorded.

| | Tube Diameter (mm) | Pressure Drop (mm WG) | TPM Removed (%) |
|---|---|---|---|
| A | 0.4 | 190 | 45 |
| B | 0.6 | 140 | 32 |
| C | 0.8 | 100 | 24 |
| D | 1.0 | 70 | 19 |
| E | 1.2 | 40 | 15 |
| F | 1.4 | 20 | 12 |

From these results, it is concluded that devices C, D and E offer particularly useful combinations of required results, namely a sufficiently high pressure drop and sufficiently low TPM removal effect. Devices A and B are unacceptable mainly on account of the excessive TPM removal. Naturally other parameters can also be varied, for example the length of the device, in order to obtain acceptable combinations of results. In the particular case of the device of FIG. 2, some part of the overall TPM removal is to be attributed to removal of TPM as a result of the smoke encountering that part of the cellulose acetate tow 8 which is located on the upstream side of the sealant-material barrier 10. In the case of the device of FIG. 2, therefore, the TPM removal effect of the device could be reduced by reducing the length of, or eliminating, the said upstream portion of the cellulose acetate. One practical way so to modify the device of FIG. 2 would be first to produce a double-length element and to heat mould the groove 9 at the mid point of the double length and, after depositing sealant material in the groove, to sever the element at the central plane of the groove to produce two end-sealed single length elements without cellulose acetate on the upstream side of the sealant material.

What is claimed is:

1. A smoking article comprising a smoking-material rod and, to one end thereof, a flow-impedance device comprising a rod-like element of foam or fibrous material impervious to the flow of smoke therethrough and at least one open-ended smoke-flow passage means extending from one end to the other of the element, the pressure drop of the said passage means, determined at a flow rate through the device of 17.5 $cm^3$ per second, being in the range from 40 to 200 mm water gauge and said device being enclosed in a wrapping permitting inward flow of ambient air therethrough into the device, the said device having air-conducting means whereby air flowing inwardly through the said wrapping can be conducted to and outwardly from the mouth end of the said device, which device is effective to remove not more than 25% of the total particulate matter of the smoke passing through the device when the smoking article is smoked.

2. A smoking article according to claim 1, wherein the said pressure drop is in the range from 50 to 100 mm water gauge.

3. A smoking article according to claim 1 or 2, wherein the said removal of total particulate matter does not exceed 20%.

4. A smoking article according to claim 1 or 2 wherein the said smoke-flow passage means is formed as at least one bore in the said material.

5. A smoking article according to claim 1 or 2, wherein the said smoke-flow passage means is defined by at least one capillary tube.

6. A smoking article according to claim 1 or 2, wherein a single smoke-flow passage has an internal diameter in the range of from 0.5 to 1.5 mm.

7. A smoking article according to claim 1 or 2, having a said smoke-flow passage disposed co-axially in the rod shaped element.

8. A smoking article according to claim 1, wherein a smoke-impervious barrier is provided at a location, in the said rod-shaped element, remote from the mouth end thereof.

9. A smoking article according to claim 1, wherein the said air-conducting means comprises at least one air-flow passage extending from a location short of the tobacco end of the element to the mouth end thereof.

10. A smoking article according to claim 9, wherein the said smoke-flow passage means comprises a passage extending coaxially in the rod-shaped element and at least one air-flow passage is located at the periphery of the rod-shaped element.

11. A smoking article according to claim 1, wherein the said device further comprises a low-pressure drop filter spaced from the downstream end of the rod-shaped element.

* * * * *